United States Patent [19]

Fukuroi

[11] 4,268,939

[45] May 26, 1981

[54] SLIDER FOR A LARGE SIZED SLIDE FASTENER

[75] Inventor: Takeo Fukuroi, Uozu, Japan

[73] Assignee: Yoshida Kogyo K.K., Tokyo, Japan

[21] Appl. No.: 54,439

[22] Filed: Jul. 3, 1979

[30] Foreign Application Priority Data

Jul. 7, 1978 [JP] Japan ..... 53/93721[U]

[51] Int. Cl.[3] ..... A44B 19/00

[52] U.S. Cl. ..... 24/205.15 R

[58] Field of Search ..... 24/201, 205, 215 R, 24/215 E

[56] References Cited

U.S. PATENT DOCUMENTS 2,458,914 1/1949 Morin ..... 24/205.15 R

FOREIGN PATENT DOCUMENTS 1920444 11/1970 Fed. Rep. of Germany .... 24/205.15 R
1039704 10/1953 France ..... 24/205.15 R
330102 5/1958 Switzerland ..... 24/205.15 R
564703 10/1944 United Kingdom ..... 24/205.15 R

*Primary Examiner*—Roy D. Frazier
*Assistant Examiner*—Peter A. Aschenbrenner
*Attorney, Agent, or Firm*—Hill, Van Santen, Steadman, Chiara & Simpson

[57] ABSTRACT

A slider for a large sized slide fastener which includes a slider body of synthetic resin material and an integrally formed metal core member embedded in the slider body. The slider body includes opposed top and bottom planes and a neck portion connecting the top and bottom planes at one end thereof. The core member includes portions each corresponding to the top plane, the bottom plane and the neck portion of the slider body and extends substantially uniformly throughout the entire area of the slider body. The core member further includes at least in the portions corresponding to the top and bottom planes a plurality of apertures or recesses which receive a portion of the synthetic resin material of the slider body upon molding thereof.

7 Claims, 14 Drawing Figures

SLIDER FOR A LARGE SIZED SLIDE FASTENER

This invention relates to a slider for a relatively large sized slide fastener such as is used in an oil fence, a fish net and the like.

In most of the slide fasteners which are used in the oil fence, fish net and the like, slide fasteners which include large sized fastener elements are used, because they are subject to heavy loads. These large sized fastener elements naturally need the use of a large sized slider. Also, in these days, synthetic resin slide fasteners are widely used because they are easier to produce, cost less to produce, etc. However, the strength of synthetic resin materials is, in general, far less than that of metals. In addition to this, the large sized slide fasteners of this type are usually installed in places where heavy load is applied. Therefore, deformation of such large sized slide fasteners, including expansion of the space between the top and bottom planes, is apt to be caused through long time use, and such deformation leads to biting by the sliders of the fastener tapes and of the objects to which the tapes are attached. Further, such deformation impairs the smooth sliding movement of the sliders to the extent that play is caused and interengagement of the fastener elements is lost.

In order to avoid such defects, some attempts have been made heretofore. For example, U.S. Pat. No. 2,252,090 and U.S. Pat. No. 2,458,914 disclose sliders which incorporate a metal insert or reinforcement in a non-metal slider body to give greater strength to the slider. However, these patents are not directed to large sized sliders. And, the bond between the metal insert and the non-metal slider body is not strong enough to withstand to the heavy load applied thereto, and thus the non-metal slider body tends to separate from the metal insert. Also, in the sliders of these patents, as the bond between the insert and slider body is relatively weak, the slider body tends to separate from the insert due to thermal expansion under high temperatures. This separation of the slider body from the insert impairs the smooth movement between the slider and fastener elements.

Therefore, an object of this invention is to provide a large sized slider whereby any deformation including expansion of the space between the top and bottom planes under heavy load can be avoided.

Another object of this invention is to provide a large sized slider wherein separation between the slider body and the insert under heavy load or high temperature can be avoided.

The present invention may be summarized as a large sized slider including a slider body of synthetic resin material and an integrally formed metal core member embedded in the body, the core member including portions each corresponding to top plane, bottom plane and neck portion of the slider body and characterized in that the core member includes at least in the portions corresponding to the top and bottom planes a plurality of apertures or recesses which receive a portion of the synthetic resin material of the slider body upon molding thereof.

Figure 1:
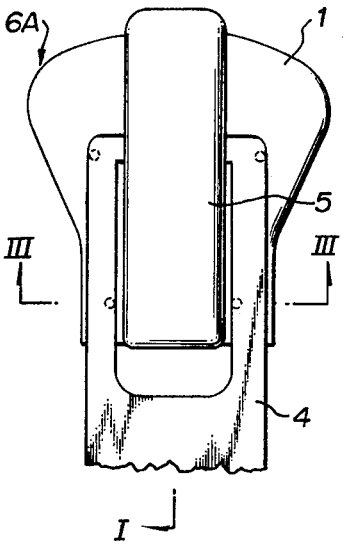
FIG. 1 is a plane view of a slider in accordance with the present invention showing basic elements of the slider.

Hereinafter, several preferred embodiments of this invention will be explained together with accompanying drawings. Firstly, stating about basic elements of this invention, throughout the drawings, the reference numerals 1 and 2 respectively denote the opposite top and bottom planes of the slider body 6A which form a Y shaped channel S through which the fastener elements (not shown) can be passed, the reference numeral 3 denotes a neck portion of the slider body 6A which connects the top and bottom planes 1 and 2 at one end thereof to form the Y shaped channel S by which the fastener elements are guided, the reference numeral 4 denotes a pull tab swivelably supported on the top plane 1, and the reference 5 denotes a lug to which the pull tab is attached. Next, each embodiment is separately explained.

Figure 2:
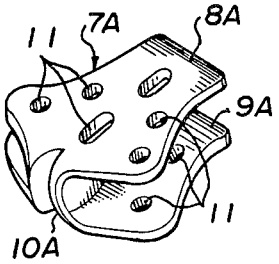
FIG. 2 is a perspective view of the core member of the slider of FIG. 1.
Figure 4:
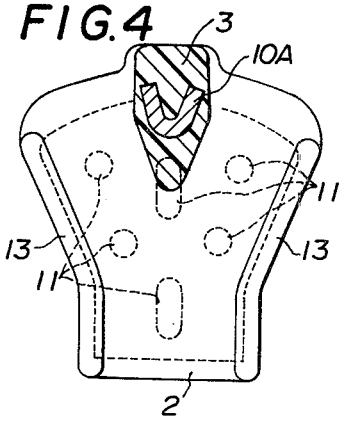
FIG. 4 is a sectional view taken along line II—II of FIG. 3 showing sectional figure of the neck portion and embedded state of the core portion corresponding to the neck portion.

First Embodiment (FIG. 2 to FIG. 5):

In this embodiment, the metal core member 7A is fully embedded within the slider body 6A. The metal core member 7A has substantially the same figure as that of the slider body 6A as shown in FIG. 2, and includes portions 8A, 9A and 10A each corresponding to the top plane 1, the bottom plane 2 and the neck portion 3 of the slider body 6A, with the portion 10A connecting said portions 8A and 9A to each other. This metal core member 7A may be integrally formed by press working. These corresponding portions 8A and 9A of the core member 7A are formed with a plurality of apertures 11 substantially over their entire area so that the synthetic resin material 12 of the slider body 6A can flow through these apertures 11 into corner portions of the mold cavity (not shown) upon molding and adhesion of the synthetic resin material 12 to the metal core member 7A is increased. Namely, after molding of the slider body 6A (hereinafter set forth), the portions of the synthetic resin material 12 covering both surfaces of each of the core portions 8A and 9A are united to each other by the synthetic resin material which has flowed into the apertures 11. Therefore, these synthetic resin material portions covering both surfaces of each of the core portions 8A and 9A do not separate from the corresponding core portions even when subjected to heavy load or high temperature. Incidentally these apertures 11 may be provided in the core portion 10A corresponding to neck portion 3 of the slider body. By this, the bond between the synthetic resin material 12 and the core member 7A can be further strengthened.

Figure 3:
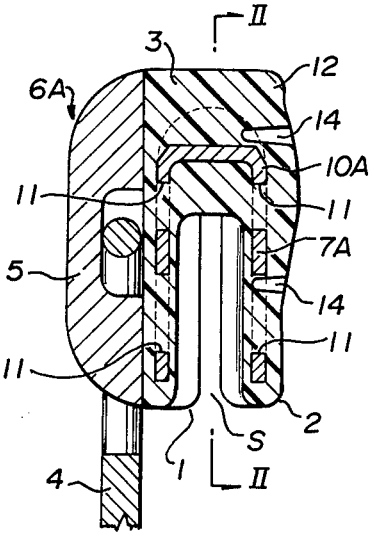
FIG. 3 is a sectional view taken along line I—I of FIG. 1 showing the core member in embedded state.
Figure 5:
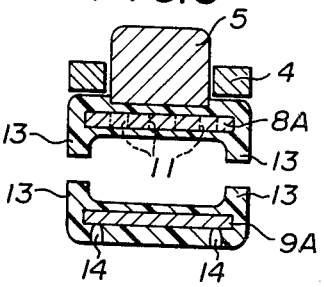
FIG. 5 is a sectional view taken along line III—III of FIG. 1 with portion cut away showing embedded state of the core portions corresponding to the top and bottom planes.
Figure 6:
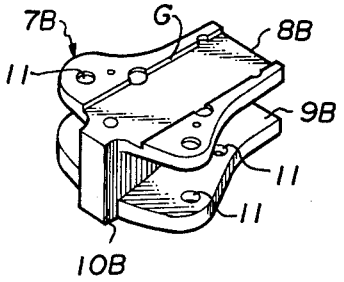
FIG. 6 is a perspective view of the core member of a second embodiment of this invention.

Upon molding, the metal core member 7A is disposed within the mold cavity (not shown) and is embedded in the slider body 6A by filling the mold cavity with the synthetic resin material 12 under high pressure. In this manner, the core member 7A is fully embedded within the synthetic resin material 12, as shown in FIG. 3, with the corresponding portion 10A being positioned substantially at central position of the neck portion 3 of the slider body 6A (FIG. 4) and with the opposite side edges of the corresponding portions 8A, 9A terminating in the proximity of flanges 13, which are formed at the side edges of the top and bottom plates 1, 2 of the slider body 6A (FIG. 5). Incidentally, the reference numeral 14 denotes recesses formed by the spacer members provided on the inner surfaces of the mold cavity. Thus, by uniformly embedding within the slider body 6A of synthetic resin material the metal core member 7A having substantially the same figure as that of the slider body, the strength of the resulting slider is increased. And especially, since a plurality of apertures 11 is provided in the core portions 8A and 9A, the bond between slider body 6A of synthetic material 12 and the metal core member 7A is greatly strengthened and, thus, the resulting slider is very suitable for use in large sized fasteners.

Second Embodiment (FIG. 6 to FIG. 9):

In this embodiment, the metal core member 7B is formed by die casting. As in the first embodiment, the core member 7B has substantially the same figure as that of the slider body 6B and includes portions 8B, 9B and 10B each corresponding to the top plane 1, the bottom plane 2 and the neck portion 3 of the slider body 6B respectively. In this embodiment, however, the portion 10B of the core member corresponding to the neck portion 3 of the slider body 6B is thick.

Figure 7:
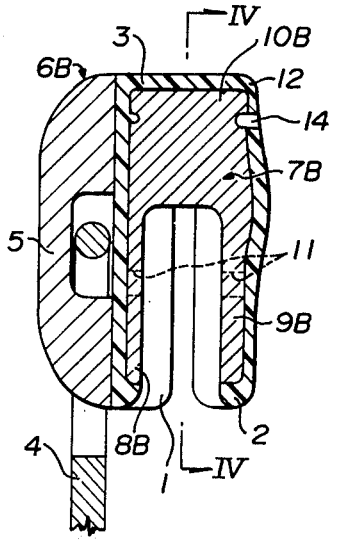
FIG. 7 is a view similar to FIG. 3 but showing embedded state of the core member of FIG. 6.
Figure 8:
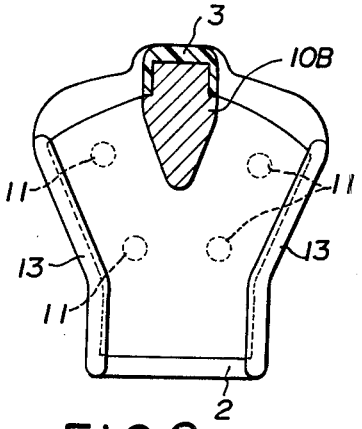
FIG. 8 is a sectional view taken along IV—IV of FIG. 7 showing embedded state of core portion corresponding to the neck portion.
Figure 9:
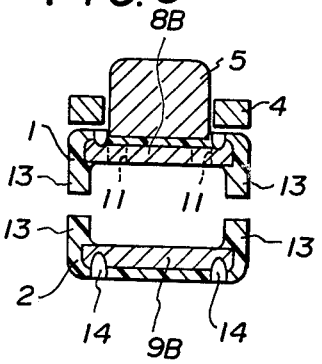
FIG. 9 is a view similar to FIG. 5 but showing embedded state of the core member of FIG. 6.
Figure 10:
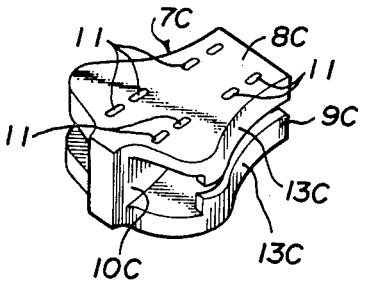
FIG. 10 is a perspective view of the core member of a third embodiment of this invention.
Figure 11:
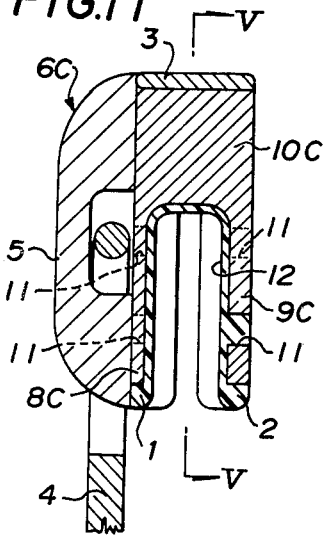
FIG. 11 is a view similar to FIG. 3 but showing embedded state of the core member of FIG. 10.
Figure 12:
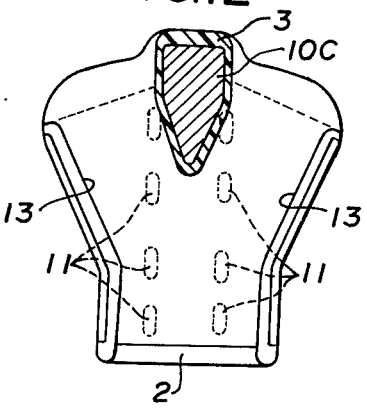
FIG. 12 is a sectional view taken aong line V—V of FIG. 11 showing embedded state of core portion corresponding to the neck portion.

Further, the core member 7B is partially embedded within the synthetic resin material 12 so that the inside surfaces thereof are exposed to the inside of the resulting slider (FIG. 7 to FIG. 9). Thus, by exposing the inside surfaces of the metal core member 7B to the inside of the resulting slider, the abrasion of the inside surfaces of the slider due to the friction with the fastener elements can be avoided. In the same manner as in the first embodiment, a plurality of apertures 11 are provided in the corresponding portions 8B and 9B of the core member 7B to increase the strength of the bond between the synthetic material 12 and the core member 7B. In addition to this apertures 11, a shallow groove G is provided in the upper surface of the corresponding portion 8B. By this arrangement, the strength of the bond is further increased.

Figure 13:
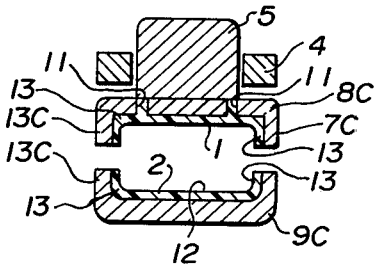
FIG. 13 is a view similar to FIG. 5 but showing embedded state of the core member of FIG. 10.

Third Embodiment (FIG. 10 to FIG. 13):

In this embodiment, the metal core member 7C, like core member 7B in the second embodiment, is formed by die casting. As in the first and second embodiments, the core member 7C has substantially the same figure as that of the slider body 6C and includes portions 8C, 9C and 10C each corresponding to the top plane 1, the bottom plane 2 and the neck portion 3 of the slider body 6C. In this embodiment, however, the portion 10C corresponding to the neck portion is thick and the portions 8C and 9C corresponding to the top and bottom plates 1, 2 are provided along both side edges thereof with portions 13C corresponding to the flanges 13 of the slider body 6C so as to cover these flanges 13 (FIG. 13). Also, the core member 7C is partially embedded within the synthetic resin material 12 so that the outer surfaces of these portions 8C, 9C and 13C are exposed to outside of the resulting slider and the corresponding portion 10C is fully embedded within the neck portion 3 of the slider body 6C. Further, in the same manner as in the first and second embodiment, a plurality of apertures 11 is provided in the corresponding portions 8C and 9C of the core member 7C to increase the strength of the bond between the synthetic resin material 12 and the metal core member 7C. Although the core member 7C provided with flanges is embedded in the slider body 6C so that its outer surfaces are exposed to outside of the resulting slider in this embodiment, the core member 7C may be embedded in the slider body 6C so that their inner surfaces are exposed to inside of the resulting slider or it may be fully embedded in the resulting slider.

Figure 14:
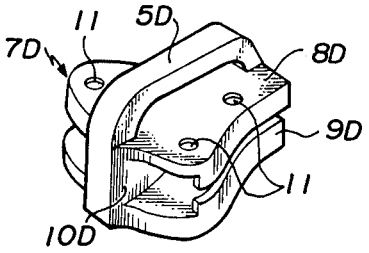
FIG. 14 is a perspective view of the core member of still another embodiment of this invention.

Fourth Embodiment (FIG. 14):

In this embodiment, the metal core member 7D, like core members in the above stated embodiments, has substantially the same figure as that of the slider body (not shown) and includes portions 8D, 9D and 10D each corresponding to the top plane, the bottom plane and the neck portion of the slider body. The core member 7D of this embodiment, further includes on the corresponding portion 8D a portion 5D corresponding to the lug 5 (FIG. 1). This corresponding portion 5D extends from the leading end of the corresponding portion 8D to the trailing end of the same and is integrally formed with the core member 7D. Thus, by integrally forming the corresponding portion 5D with the core member 7D and by embedding this core member in the slider body, the strength of the resulting slider is further increased, because all portions of the resulting slider which receive outer force are reinforced by the unified core member 7D.

Although the spacer members, which maintain a space between the mold cavity and the core member 7 to receive the synthetic resin material 12 therein upon molding, are provided on the inner surfaces of the mold cavity in the above embodiments, these spacer members may be provided on the outer surfaces of the core member 7. And although the aperture 11 are provided only in the core portions 8 and 9 corresponding to the top and bottom plane 1 and 2 of the slider body 6, these apertures 11 may be further provided in core portion 10 corresponding to the neck portion 3 of the slider body 6. By this arrangement, the strength of the bond between the slider body 6 and the metal core member 7 is further increased. Instead of these apertures 11, a plurality of recesses may be provided in the surfaces of the core member which face the synthetic resin material upon molding.

Thus, in the slider of this invention, since the metal core member is fully or partially embedded within the slider body of synthetic resin material so that it continuously and substantially uniformly extends throughout all portions of the slider, the strength of the slider can be greatly increased. In addition to this, since the reinforcement by the core member of this invention is total, not partial, stress concentration can be avoided, so that deformation including expansion of the space between the top and bottom planes can be prevented. Therefore, biting of the fastener tapes and of the object attached to the tapes by the slider can be avoided and smooth slide movement of the slider can be maintained. And further, in the slider of this invention, since a plurality of apertures or recesses is provided in the metal core member, the strength of the bond between the slider body of synthetic resin material and the metal core member is increased, and thus separation therebetween can be prevented even if the slide fastener is used under heavy load or high temperature.

What is claimed is:

1. In a slider for a large sized slide fastener comprising a slider body of synthetic resin material and an integrally formed metal core member embedded in said slider body, said slider body including opposed top and bottom planes and a neck portion connecting said top and bottom planes at one end thereof, said core member including portions each corresponding to said top plane, the bottom plane and the neck portion of said slider body and substantially uniformly extending throughout the entire area of said slider body, characterized in that said core member including in the portions corresponding to the top plane, bottom plane and neck portion of said slider body a plurality of apertures or recesses which receive a portion of the synthetic resin material of said slider body upon molding thereof.

2. In a slider for a large sized slide fastener comprising a slider body of synthetic resin material and an integrally formed metal core member embedded in said slider body, said slider body including opposed top and bottom planes and a neck portion connecting said top and bottom planes at one end thereof, said core member including portions each corresponding to said top plane, the bottom plane and the neck portion of said slider body and substantially uniformly extending throughout the entire area of said slider body, said core member including at least in the portions corresponding to said top and bottom planes a plurality of apertures or recesses which receive a portion of the synthetic resin material of said slider body upon molding thereof, wherein the said core member is fully embedded in the slider body.

3. A slider as defined by claim 2, wherein the said slider body further includes flanges on opposite sides each of the top and bottom planes, and said core member further includes portions corresponding to these flanges and embedded in the same.

4. A slider as defined by claim 2, wherein the said slider body further includes a lug on the upper surface of said top plane, and said core member further includes a portion corresponding to this lug and embedded in the same.

5. In a slider for a large sized slide fastener comprising a slider body of synthetic resin material and an integrally formed metal core member embedded in said slider body, said slider body including opposed top and bottom planes and a neck portion connecting said top and bottom planes at one end thereof, said core member including portions each corresponding to said top plane, the bottom plane and the neck portion of said slider body and substantially uniformly extending throughout the entire area of said slider body, said core member including at least in the portions corresponding to said top and bottom planes a plurality of apertures or recesses which receive a portion of the synthetic resin material of said slider body upon molding thereof, wherein the said core member is partially embedded in the slider body so that the outer surfaces of said core member are exposed outside of the resulting slider.

6. A slider as defined by claim 5, wherein the said slider body further includes flanges on opposite sides of each of the top and bottom planes, and said core member further includes portions corresponding to these flanges and covering the same.

7. In a slider for a large sized slide fastener comprising a slider body of synthetic resin material and an integrally formed metal core member embedded in said slider body, said slider body including opposed top and bottom planes and a neck portion connecting said top and bottom planes at one end thereof, said core member including portions each corresponding to said top plane, the bottom plane and the neck portion of said slider body and substantially uniformly extending throughout the entire area of said slider body, said core member including at least in the portions corresponding to said top and bottom planes a plurality of apertures or recesses which receive a portion of the synthetic resin material of said slider body upon molding thereof, wherein the said core member is partially embedded in the slider body so that the inner surfaces of said core member are exposed to the inside of the resulting slider, said slider body further includes flanges on opposite sides each of the top and bottom planes, and said core member further includes portions corresponding to these flanges and covered by the same.

* * * * *